US009173485B2

(12) United States Patent
Fischer et al.

(10) Patent No.: US 9,173,485 B2
(45) **Date of Patent: *Nov. 3, 2015**

(54) SELF-EXPANDING, LOAD-BEARING MECHANISM FOR DISPLAY UNITS

(71) Applicant: KFR Enterprises, LLC, Danbury, CT (US)

(72) Inventors: Robert Fischer, Danbury, CT (US); Fredrik Karlehag, Norwalk, CT (US)

(73) Assignee: KFR Enterprises LLC, Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/215,454

(22) Filed: Mar. 17, 2014

(65) Prior Publication Data

US 2014/0265777 A1 Sep. 18, 2014

Related U.S. Application Data

(60) Provisional application No. 61/798,002, filed on Mar. 15, 2013.

(51) Int. Cl.

| | |
|---|---|
| ***A47B 43/02*** | (2006.01) |
| ***A47B 43/00*** | (2006.01) |
| ***A47F 5/11*** | (2006.01) |
| ***G09F 1/06*** | (2006.01) |

(52) U.S. Cl.

CPC ..... *A47B 43/00* (2013.01); *A47B 43/02* (2013.01); *A47F 5/112* (2013.01); *G09F 1/065* (2013.01)

(58) Field of Classification Search

CPC ..... G09F 15/0062; A47F 5/11; A47F 5/118; A47B 43/02; A47B 47/0075; A47B 3/002

USPC ..... 108/162, 165, 167, 171, 115, 157.18, 108/159, 157.14; 211/135; 40/610, 539, 40/124.09; 248/459, 560, 150

See application file for complete search history.

(56) References Cited

U.S. PATENT DOCUMENTS

| | | | | |
|---|---|---|---|---|
| 3,188,158 | A * | 6/1965 | Sanchez | 312/277 |
| 3,727,979 | A * | 4/1973 | Schier et al. | 297/440.12 |
| 5,382,081 | A * | 1/1995 | Henry | 297/440.12 |
| 6,347,772 | B1 | 2/2002 | L'Hotel | |

(Continued)

FOREIGN PATENT DOCUMENTS

| | | |
|---|---|---|
| DE | 102012001264 | 8/2012 |
| EP | 2174573 | 4/2010 |
| GB | 2482313 | 2/2012 |

OTHER PUBLICATIONS

Written Opinion for Application No. PCT/US14/054585 dated Dec. 31, 2014; 10 pages.

(Continued)

*Primary Examiner* — Jose V Chen

(74) *Attorney, Agent, or Firm* — Michael D. Downs; Fincham Downs, LLC

(57) ABSTRACT

In accordance with some embodiments, a self-expanding, collapsible mechanism (e.g., for expanding an outer substrate or substrates of a display unit) and a display unit comprising at least one self-expanding, collapsible mechanism are disclosed. In one or more embodiments, a self-expanding mechanism is load-bearing. In one embodiment, a display unit may be configured to have at least one load-bearing surface (e.g., supported by one or more load-bearing inserts).

21 Claims, 10 Drawing Sheets

(56) References Cited

U.S. PATENT DOCUMENTS

| | | | | |
|---|---|---|---|---|
| 6,758,800 | B2 | 7/2004 | Boix Jaen | |
| RE38,696 | E * | 2/2005 | Williams | 40/124.08 |
| 6,848,371 | B2 * | 2/2005 | Zheng | 108/165 |
| 7,007,615 | B2 * | 3/2006 | Grueneberg | 108/165 |
| 7,159,350 | B2 | 1/2007 | L'Hotel | |
| 7,437,842 | B2 | 10/2008 | Sgambellone | |
| 7,634,865 | B2 | 12/2009 | L'Hotel | |
| 7,726,054 | B2 | 6/2010 | Mestres Armengol et al. | |
| 7,748,798 | B2 * | 7/2010 | LeTourneau et al. | 312/258 |
| 7,980,016 | B2 | 7/2011 | L'Hotel | |
| 8,099,883 | B2 | 1/2012 | Mestres Armengol et al. | |
| 8,112,925 | B2 | 2/2012 | Tzuo | |
| 8,181,375 | B2 * | 5/2012 | Tzuo | 40/610 |
| 8,286,809 | B2 * | 10/2012 | Mestres Armengol et al. | 211/149 |
| 8,826,833 | B1 * | 9/2014 | Fischer et al. | 108/165 |
| 2002/0171023 | A1 | 11/2002 | L'Hotel | |
| 2008/0244948 | A1 | 10/2008 | L'Hotel | |
| 2010/0000131 | A1 | 1/2010 | Tzuo | |

OTHER PUBLICATIONS

International Search Report for Application No. PCT/US14/054585 dated Dec. 31, 2014; 2 pages.

* cited by examiner

FIG. 7
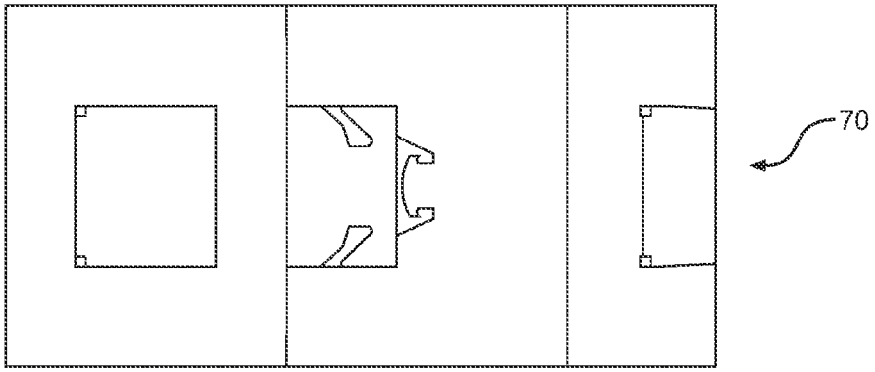
FIG. 8
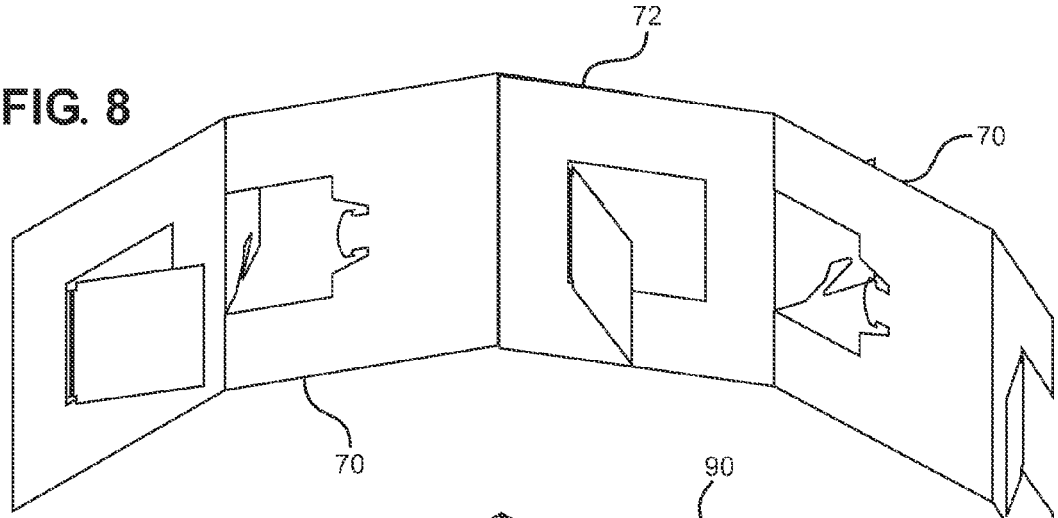
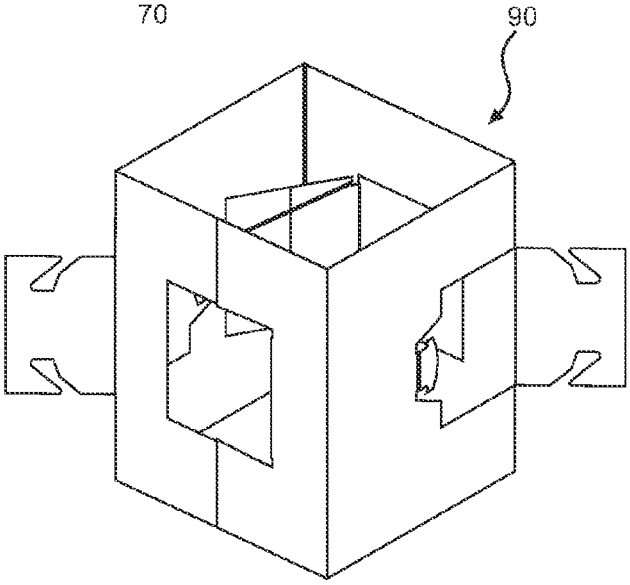
FIG. 9

SELF-EXPANDING, LOAD-BEARING MECHANISM FOR DISPLAY UNITS

CROSS-REFERENCE TO RELATED APPLICATIONS

The present application claims the benefit of priority of U.S. Provisional Patent Application No. 61/798,002 filed Mar. 15, 2013, entitled "Self-expanding, Load-bearing Mechanism for Display Units," which is incorporated by reference in the present application.

BRIEF DESCRIPTION OF THE DRAWINGS

An understanding of embodiments described in this disclosure and many of the attendant advantages may be readily obtained by reference to the following detailed description when considered with the accompanying drawings, of which:

FIG. 7 is a plan view of a mechanism component according to some embodiments;

FIG. 8 is a perspective view illustrating assembly of a mechanism from two mechanism components according to some embodiments;

FIG. 9 is a perspective view of a mechanism assembled from two mechanism components according to some embodiments;

DETAILED DESCRIPTION

A. Introduction

Figure 1A:
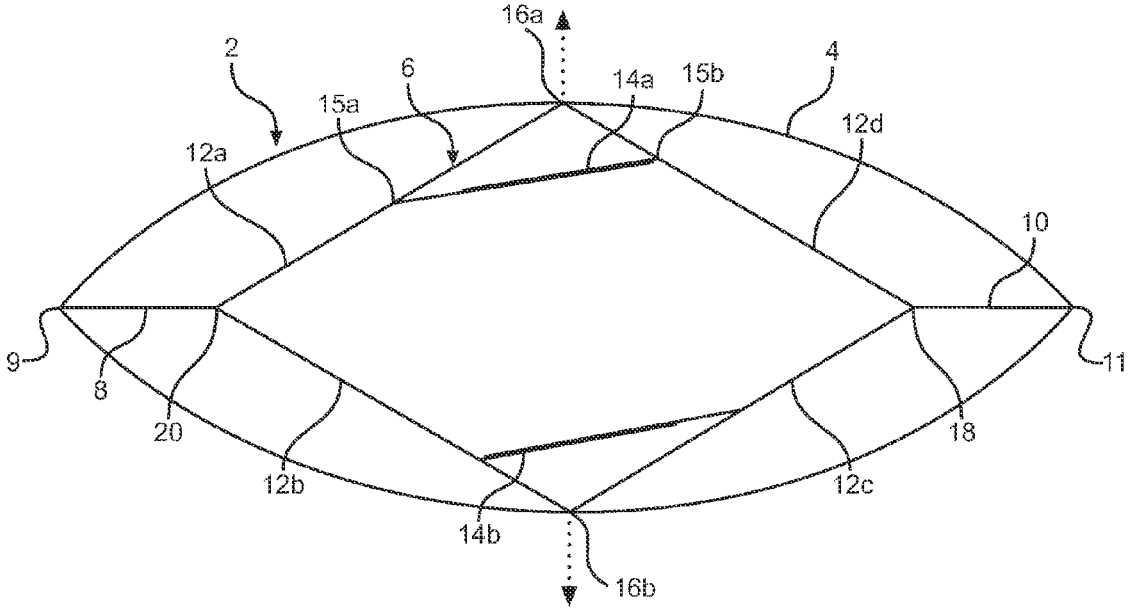
FIG. 1A is a plan view of a display unit and mechanism according to some embodiments.

Some embodiments discussed in this disclosure are descriptive of apparatus, methods, and articles of manufacture for making, assembling, and utilizing self-expanding mechanisms for display units.

Applicants have recognized that, in accordance with some embodiments described in this disclosure, some types of retailers, advertisers, consumers, sellers of information display units and other types of users may find it beneficial to have a collapsible and expandable display unit configured with one or more collapsible and expandable, load-bearing mechanisms for bearing, by way of example and without limitation, products, gifts, and/or other types of items.

Some embodiments discussed in this disclosure are descriptive of apparatus, methods, and articles of manufacture for making, assembling, and utilizing load-bearing inserts for display units. Some embodiments discussed in this disclosure are descriptive of display units configured to have a load-bearing surface (e.g., supported by one or more load-bearing inserts).

Some embodiments discussed in this disclosure are descriptive of apparatus, methods, and articles of manufacture for display units utilizing one or more self-expanding and/or load-bearing mechanisms.

As used in this disclosure, the term "mechanism" may refer to an article of manufacture or apparatus that when assembled, is configured to be collapsible and self-expanding. The term "insert" may refer to such a mechanism when used, for example, in a display unit (e.g., to expand an outer substrate or substrates of the display unit). In some embodiments, mechanism may be used without an outer substrate for displaying formation (e.g., may be used as a free-standing support for a load-bearing surface).

Applicants have recognized that, in accordance with some embodiments described in this disclosure, some types of retailers, advertisers, consumers, sellers of information display units and other types of users may find it beneficial to have a display unit that expands utilizing at least one insert configured to expand and push symmetrically on opposing sides of the display unit.

Some embodiments discussed in this disclosure are descriptive of symmetrically-expanding inserts for display units. In one example, an insert for a display unit expands symmetrically and pushes simultaneously outward on two opposing display portions (e.g., opposite sides) of a display unit (e.g., to expand the display unit to a free-standing display state). In another example, two points where an expanding or expanded insert symmetrically pushes the display portions outward are directly opposite one another (e.g., across the interior of the display unit).

Applicants have recognized that, in accordance with some embodiments described in this disclosure, it would be beneficial to provide for a collapsible and expandable display unit having one or more of the following features:

- can support a load (e.g., products, other items placed for display on a surface) without additional support
- can open smoothly, quickly, and/or consistently, with little effort by the user
- an expanding mechanism that pushes outward from the center of the display unit (e.g., against one or more sides of the display
- utilizes a minimal number (e.g., one or two) mechanisms to retain expanded, free standing shape
- an active mechanism that actively pushes one or more opposing sides of the display unit outward
- does not require an expanding mechanism to be immovably fixed or locked in place to the corners or edges of the display unit
- the mechanism may be flexibly connected to or suspended by the edges of the unit (e.g., to prevent the mechanism from falling down through the unit) so it may effectively "float" inside the unit, pushing outward on opposing sides of the unit, without having to pull or push on the edges to maintain the display shape A mechanism according to some embodiments described in this disclosure comprises at least one component (e.g., a piece of cardboard or other material) having at least one flap and at least one hook for affixing at least one contracting element (e.g., a rubber band).

Detailed Description

FIG. 1A depicts a top-down or plan view of a partially-opened display unit 2 comprising an outer portion 4 (e.g., a display surface or substrate) and an expanding mechanism 6. Connectors 8 and 10 connect the mechanism 6 at points 18 and 20 to the display unit edges 9 and 11, respectively. In some embodiments, the mechanism comprises connectors 8 and/or 10; in other embodiments, it does not.

The mechanism 6 further comprises sides 12*a*, 12*b*, 12*c*, and 12*d* (e.g., of cardboard or other rigid material). The mechanism 6 also comprises contracting elements 14*a* and 14*b* (which also may be referred to as pushing elements). Element 14*a*, which may comprise a rubber band, acts to pull inward on sides 12*a* and 12*d* at points 15*a* and 15*b*, respectively, causing the edge 16*a* (e.g., a corner fold) of mechanism 6 to push outward on one side of the outer portion 4. Similarly, element 14*b* acts to pull inward on sides 12*b* and 12*c*, causing the edge 16*b* of mechanism 6 to push outward on the opposite side of the outer portion 4. The contracting elements 14*a* and 14*b*, for example, cause the edges 16*a* and 16*b* to move away from each other (e.g., symmetrically). The dashed arrows in FIG. 1A represent the outward, pushing movement of points 16*a* and 16*b* and the corresponding movement of the sides of the outer portion 4.

Figure 1B:
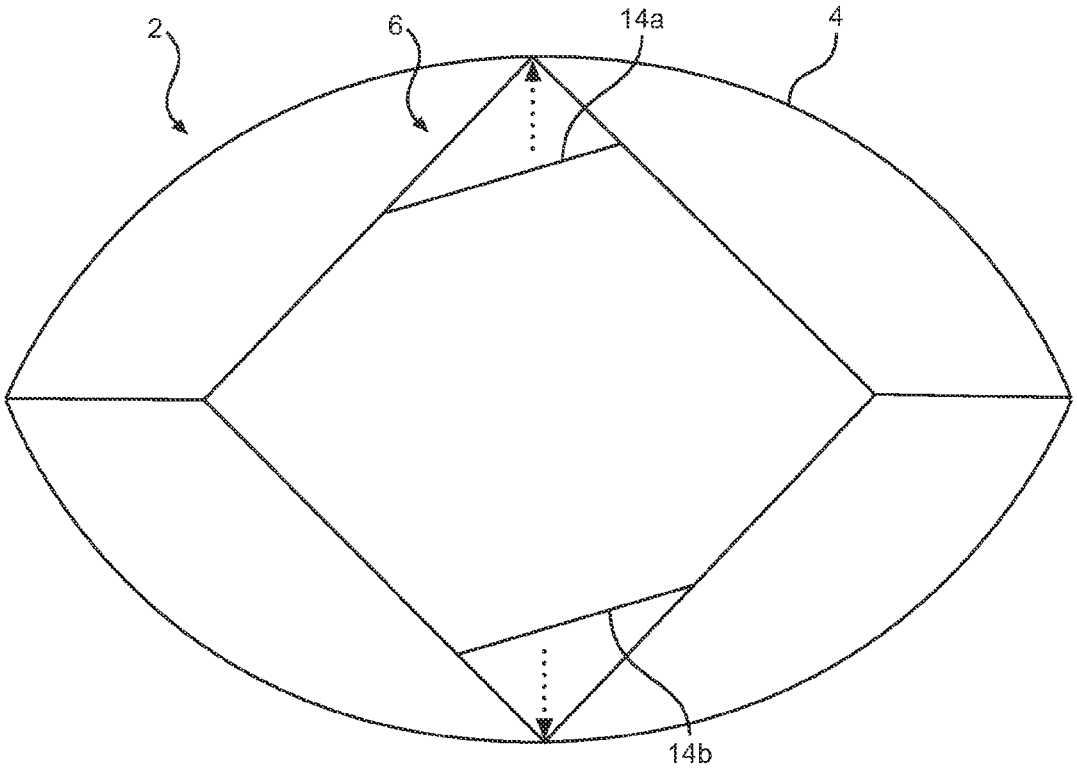
FIG. 1B is a plan view of a display unit and mechanism according to some embodiments.

FIG. 1B depicts a top-down or plan view of the display unit 2 of FIG. 1A in a fully opened or expanded configuration or state, as demonstrated by the final elliptical shape of the outer portion 4 that is wider through the middle than its shape in FIG. 1A. Contracting element 14*a* has pulled the two corresponding sides of the mechanism 6 further inward, effectuating the pushing out of the sides of the outer portion by the adjacent corners of the mechanism 6. The dashed arrows in FIG. 1B represent the travel of points 16*a* and 16*b* of FIG. 1A to their final position when the display unit 2 is fully expanded.

Figure 2A:
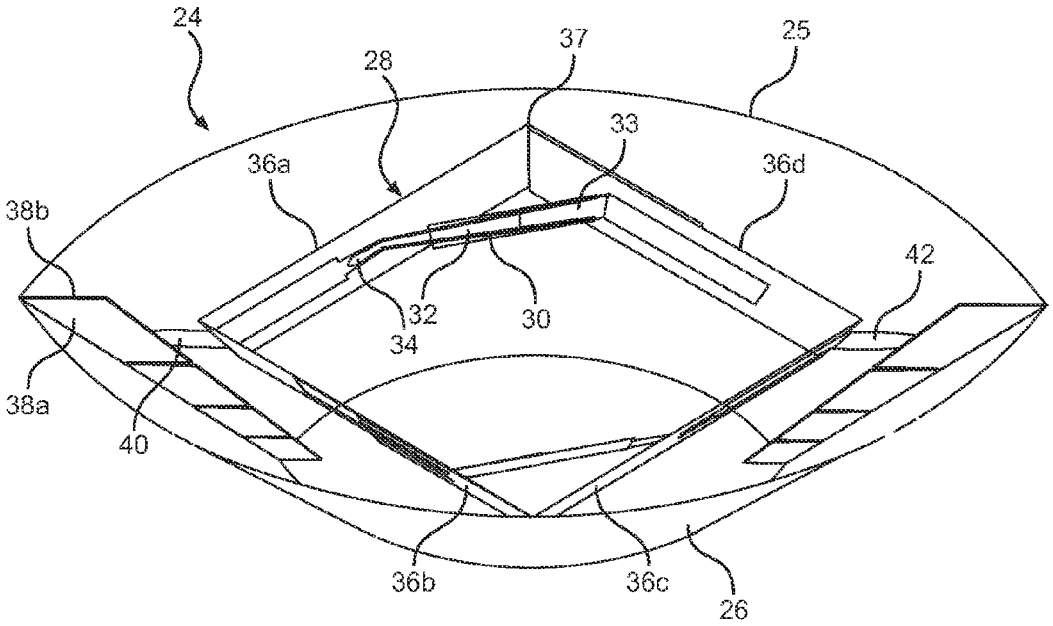
FIG. 2A is a perspective view of a display unit and mechanism according to some embodiments.

FIG. 2A depicts a perspective view of an example display unit 24, comprising substrate portions 25 and 26, in a partially open configuration. The substrate portions may, for example, be printed with advertising or other information. Folds 38*a* and 38*b* of substrate portions 26 and 25, respectively, may be used to connect the substrate portions together on the one side, and like folds may be used to connect the substrate portions together at the other edge of the display unit. As depicted in FIG. 2A, connecting flaps 40 and 42 may be folded back from sides 36*a* and 36*c*, respectively, and used to connect the mechanism 28 to one or more of the substrate portions 25 and 26 (e.g., by fixing, movably or immovably, the flaps between the folds 38*a* and 38*b*). The tension of the rubber band 30 may, in some embodiments, hold the leading edge of the flap 32 in place.

The display unit 24 further comprises a mechanism 28 as described with respect to one or more embodiments in this disclosure (e.g., an active insert, a symmetrically pushing and/or expanding insert). As depicted in FIG. 2A, the mechanism 28 comprises two separate components (e.g., two identical components) that have been assembled for use (e.g., using rubber bands) in the display unit 24. The mechanism 28 comprises a rubber band 30 attached at one end to a hook 34 on side 36*a*, and on the other end to a flap 33 (that is part of the same component as side 36*a*). In one example, the rubber band 30 may be wrapped around and held in place by notches (not shown) on flap 33. In the example, flap 33 is over and, due to the contracting tension of the rubber band, pushes and is flat against flap 32, which is part of the same component as side 36*d*. Flap 33 is inserted through the visible opening in side 36*d* in assembling the components, as discussed in further detail in this disclosure. The contracting tension of the rubber band 30 pulls sides 36*a* and 36*d* inward, effectively pushing out the corner 37 of mechanism 28 against the substrate portion 25. In some embodiments, a rubber band in the opposite corner may be pulling sides 36*b* and 36*c* inward, effectively pushing out the opposite corner of the mechanism 28 against substrate portion 26; in some embodiments, only one rubber band 30 (e.g., of sufficient tension to act alone) may be used in the mechanism 28, as the action of pulling in sides 36*a* and 36*d* would necessarily also push out the opposite corner against substrate portion 26.

Figure 2B:
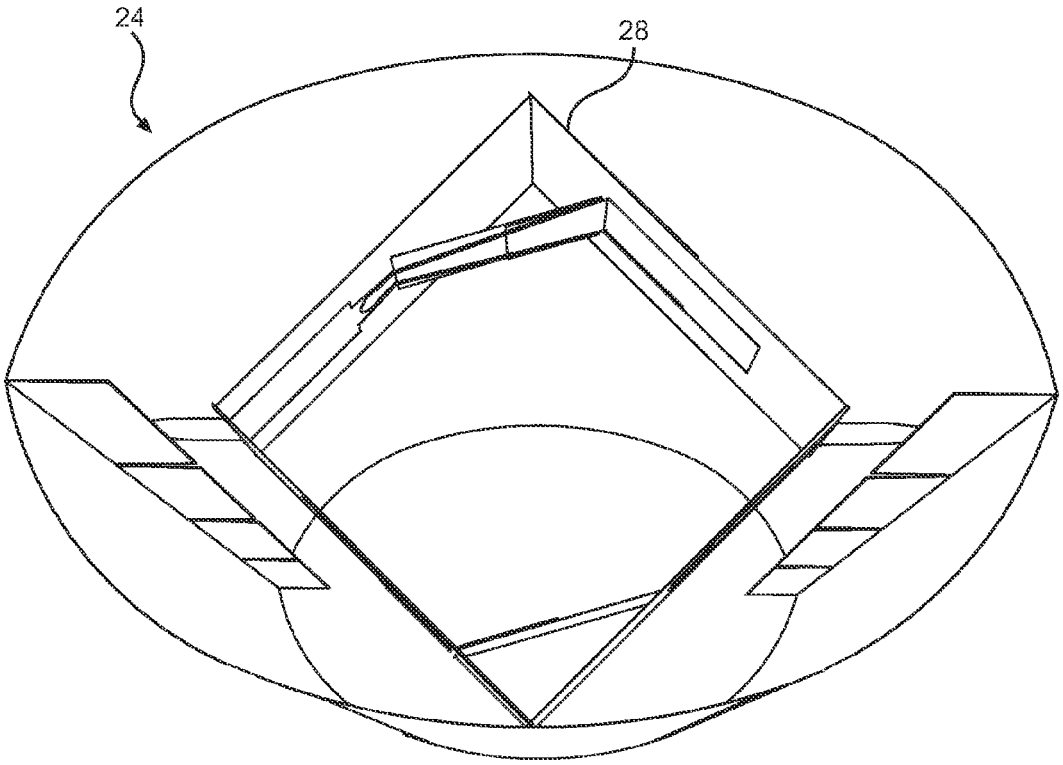
FIG. 2B is a perspective view of a display unit and mechanism according to some embodiments.

FIG. 2B depicts a perspective view of the example display unit 24 in a fully opened configuration. As depicted, the mechanism 28 has expanded and locked fully in its final diamond or square shape.

Figure 3:
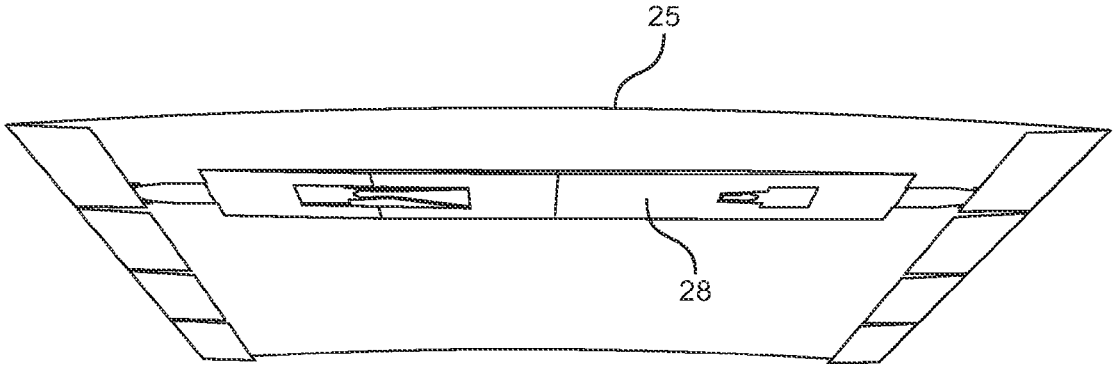
FIG. 3 is a perspective view of a display unit and mechanism according to some embodiments.

FIG. 3 depicts a perspective view of a portion or interior view of an example display unit in a collapsed or flat state. The fully flattened mechanism 28 is flush against the inside of the substrate portion 25. An opposite substrate portion, which may be attached at the edges to the substrate portion 25 to create the outer shell of a display unit in accordance with some embodiments, is not shown. FIG. 3 therefore also depicts one potential intermediate stage of assembly of a display unit, prior to adding a second substrate portion. As depicted in FIG. 3, and in accordance with some embodiments, the connecting flaps of the mechanism 28 extend from one edge of the substrate portion 25 to the other edge.

Figure 4:
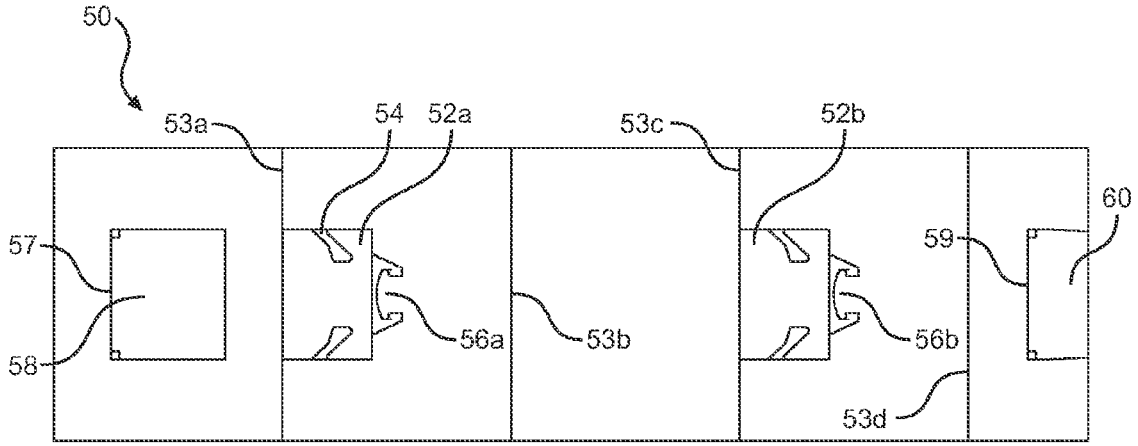
FIG. 4 is a plan view of a mechanism according to some embodiments.

FIG. 4 depicts a single mechanism component 50 from which a mechanism may be assembled. The component 50 may comprise cardboard or other rigid substrate configured with folds, flaps, and tabs for assembly into a mechanism allowing for self-expansion of the mechanism into a desired shape (e.g., a diamond, a square, a triangle). When used as an insert (e.g., in a display unit), the mechanism may push one or more sides of an outer portion of the display unit into a desired shape (e.g., an elliptical shape) so the display may be free standing. The mechanism component 50 comprises flaps 52*a* and 52*b*. In one embodiment, the flaps 52*a* and 52*b* preferably have one or more notches 54 for accepting and holding a rubber band or other connecting element (e.g., to connect the assembled mechanism to an outer portion of a display unit). The single component 50 further comprises folds 53*a*, 53*b*, 53*c*, 53*d*, 57, and 59, hooks 56*a* and 56*b*, and flaps 58 and 60. As depicted, notches may be cut out at the corners of folds 57 and 59 (e.g., for use in attaching rubber bands).

Figure 5:
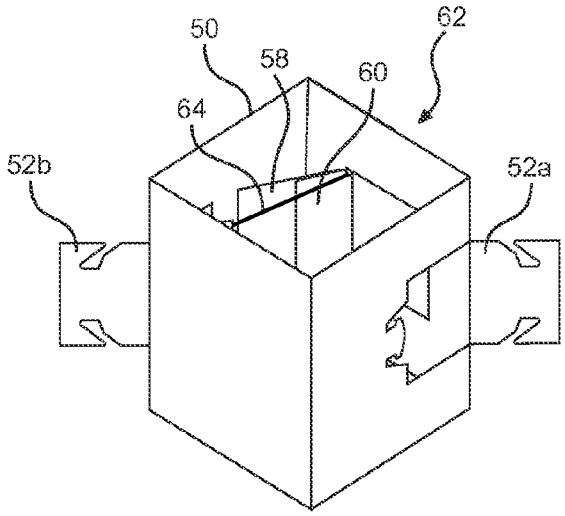
FIG. 5 is a perspective view of a mechanism according to some embodiments.
Figure 6:
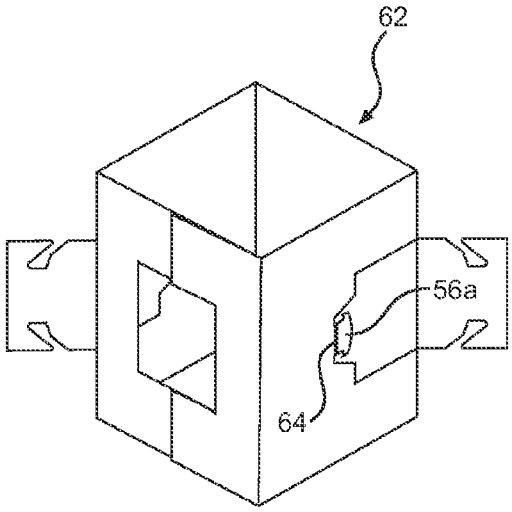
FIG. 6 is a perspective view of a mechanism according to some embodiments.

As depicted in FIG. 5, assembly of a mechanism 62 from single mechanism component 50 may comprise folding at all the folds 53*a*, 53*b*, 53*c*, 53*d* so that flap 60 may be inserted through the opening created by folding back fold 58. FIG. 6 is an alternative, rear view of the assembled mechanism 62. As depicted in FIG. 5 and FIG. 6, a rubber band 64 may hold flap 60 and flap 58 (e.g., underneath flap 60) in place by hooking the rubber band around hook 56*a* at one end, and, at the other end, around the notches formed at the corners of folds 57 and 59 when flaps 58 and 60, respectively, are folded back. Flaps 52*a* and 52*b* may be used to attach the mechanism 62 to an inside of the outer portion of a display unit.

FIG. 7 depicts a mechanism component 70, comprising some features similar to those described with respect to single component 50. However, component 70 is designed, in accordance with some embodiments, for use in assembling a mechanism from two like components. FIG. 8 depicts an intermediate stage of assembling a mechanism using a first mechanism component 70 and a second mechanism component 70. The overlap of the two components is depicted at portion 72, where the shorter flap from one component is folded through the opening created by folding back the larger flap in the other component. FIG. 9 depicts an assembled mechanism 90, in which both sets of flaps have been joined using respective rubber bands.

Figure 10A:
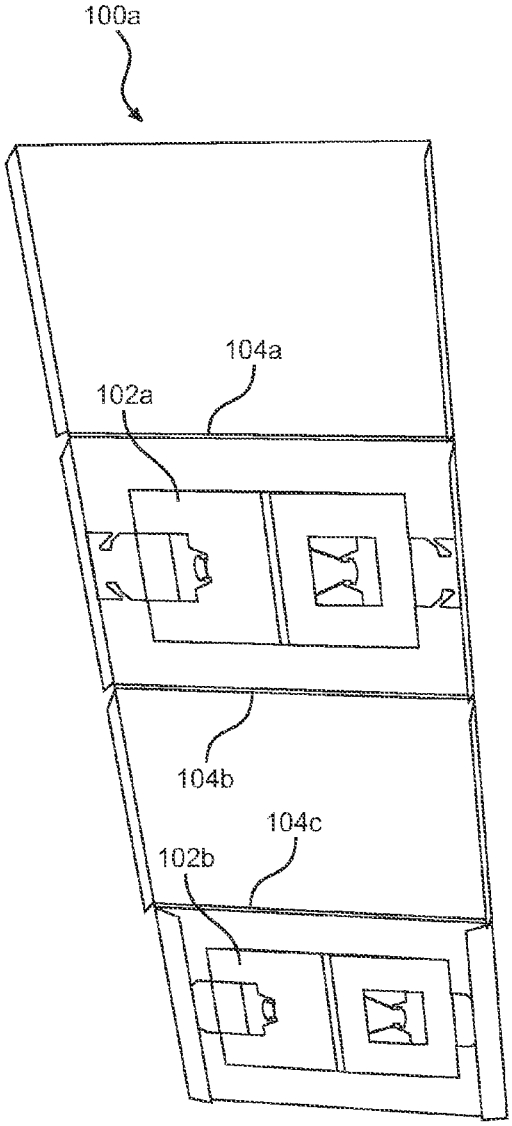
FIG. 10A is a perspective view of a substrate component for a display unit with collapsed mechanisms according to some embodiments.

FIG. 10A depicts a perspective view of a portion or interior view of an example display unit 100*a* in a collapsed or flat state. As illustrated, the display unit 100*a* comprises two mechanisms 102*a* and 102*b* (e.g., mechanisms configured to push symmetrically on opposite sides of the display unit). The portion of the display unit further comprises folds 104*a*, 104*b*, and 104*c*, which may be used for folding the display unit 100*a* conveniently for storage and/or portability.

Figure 10B:
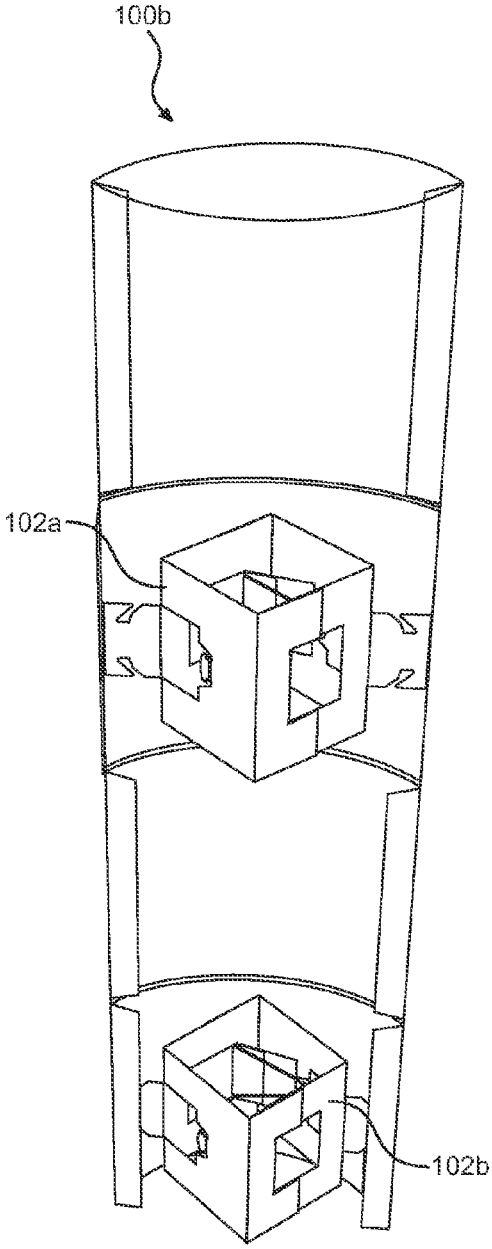
FIG. 10B is a perspective view of a substrate component for a display unit with expanded mechanisms according to some embodiments.

FIG. 10B depicts a perspective view of a portion or interior view of an example display unit 100*b* in an expanded or display state. As depicted, the mechanisms 102*a* and 102*b* are fully expanded, creating a shape for the outer portion of the display that will allow it to stand freely.

Figure 11:
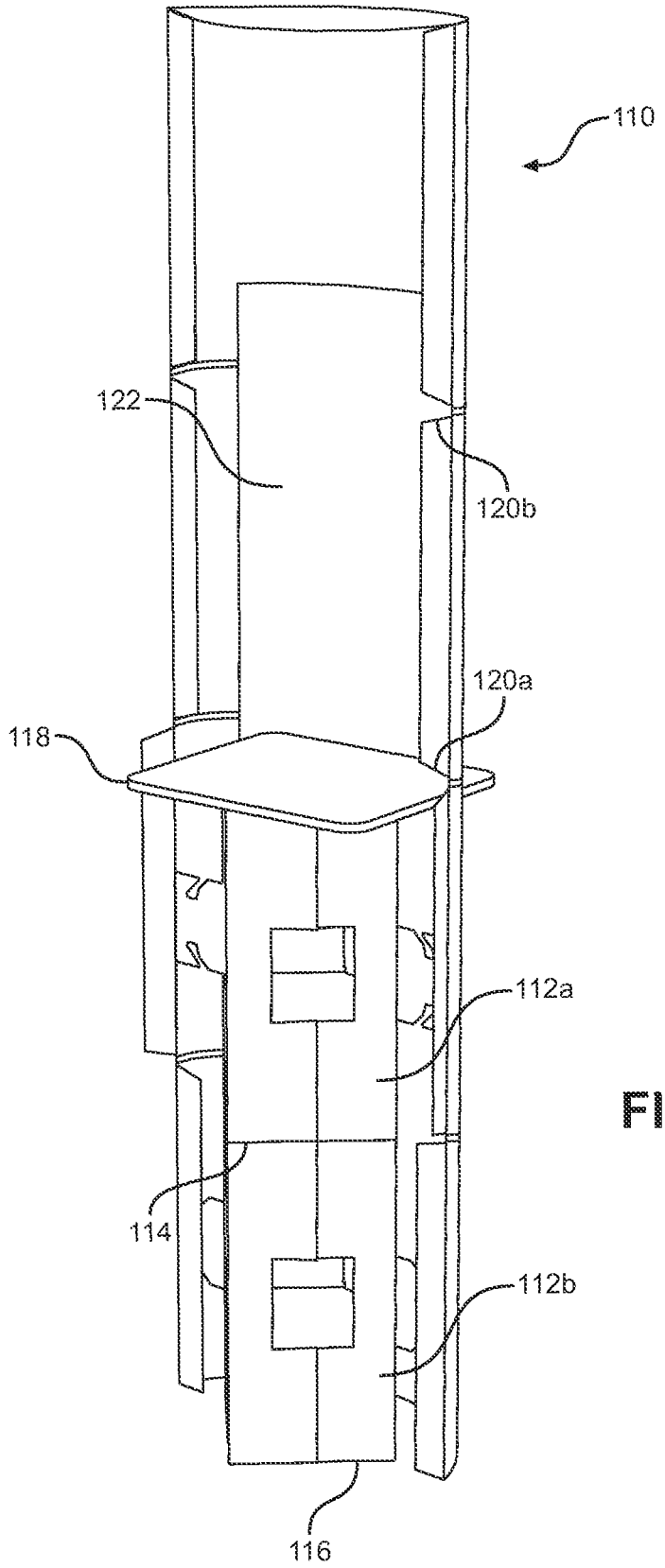
FIG. 11 is a perspective view depicting an example configuration of load-bearing mechanisms for a display unit according to some embodiments.

FIG. 11 depicts a perspective view of a portion or interior view of an example display unit 110. The display unit 110 comprises two load-bearing mechanisms 112*a* and 112*b*. Mechanism 112*a* is supported by mechanism 112*b* at edge 114. Mechanism 112*b* may be supported, for example, by a floor at edge 116. A surface 118 (e.g., a shelf) is resting on the top edge (not shown) of mechanism 112*a*, allowing both mechanisms to support the load of the surface and of any items that may be placed on it. As depicted in FIG. 11, according to some embodiments, the surface may be held in place by one or more notches, such as notch 120*a* on the depicted outer portion of the display unit 110. In some embodiments, the surface may rest on the uppermost mechanism (e.g., mechanism 112*a*) without any notches to secure it. In one embodiment, a second notch 120*b* may be used, for example, to hold another surface or shelf. When fully assembled (with an opposite substrate portion), the display unit 110 comprises a stand with a load-bearing surface. An opening 122 in at least one portion of the display unit 110 may be used to access items held on the surface 118, and/or to access items if a unit is employed as a gravity fee dispenser.

Figure 12:
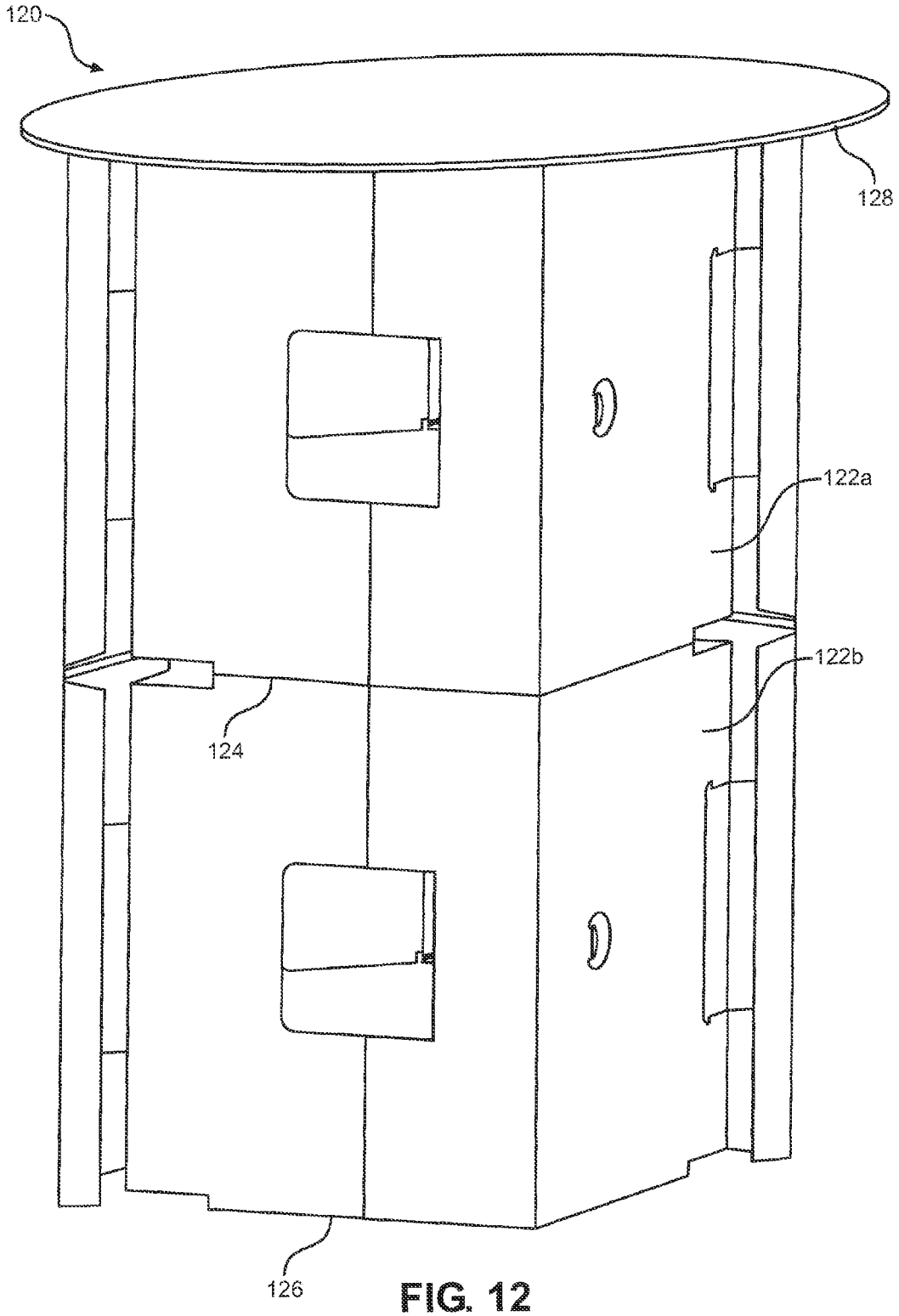
FIG. 12 is a perspective view depicting an example configuration of load-bearing mechanisms for a display unit according to some embodiments.

FIG. 12 depicts a perspective view of a portion or interior view of an example display unit 120 having a top surface 128 supported by a first mechanism 122*a* supported along an edge 124 by a second mechanism 122*b* supported on a floor or surface along edge 126.

Additional Embodiments

According to one embodiment, a two-piece mechanism comprises folds, flaps, and hooks that when assembled with two rubber bands allows for an automatic locking shape (e.g., diamond, square, triangle, or other shape) when expanded. Alternatively or in addition, the two pieces may be glued on one edge, which may require the use of only one rubber band to provide for expansion of the mechanism. For example, the rubber bands allow the mechanism to go from a flat or collapsed position into an expanded or locking shape (e.g., allowing a display unit to stand and/or providing load bearing support for a surface).

According to some embodiments, as discussed in this disclosure, when the mechanism is assembled with at least one piece of rigid substrate (e.g. paperboard) to create a front and a back for a display unit, the mechanism pushes the front and the back sides of the substrate outward, creating an elliptical or square display.

According to some embodiments, a collapsible and expandable display unit may be used as a greeting or occasion card (e.g., as a birthday card, holiday card, etc.), novelty display item, for in-store advertising and/or product delivery system, ballot boxes, take one display, table, etc.

Although reference may be made in this disclosure to particular types of information and/or uses of display units, it will be readily understood in light of this disclosure that any type of information may be displayed on a display unit (e.g., by printing on at least one outer substrate or surface of a display unit).

In one embodiment, a display unit having a load-bearing surface (e.g., supported by one or more load-bearing inserts) may be used for holding or presenting a gift, product, or other item(s).

According to some embodiments, a display unit is collapsible and expandable in an accordion-like manner (e.g., a display or occasion card that accordion folds up and down).

According to some embodiments, a display unit comprising one or more self-expanding mechanisms in accordance with this disclosure, may be expanded and/or opened, for example, by a user holding a top edge of the folded/collapsed display unit and dropping or lifting the remainder of the display (e.g., allowing gravity to unfold it) so the display unit will open and take shape automatically.

According to some embodiments, depending on the height of the display unit, fewer mechanisms may be required than may be utilized by other types of display units of similar height. The tension aggression (e.g., the contracting force of a rubber band or other contracting element) of one or more mechanisms may be increased to require fewer mechanisms overall to achieve a stable, free standing display unit without the tension causing crimping in the sides of the display unit because the tension of the mechanism is used to push the sides outward, rather than inward. In some embodiments, the symmetrical expansion of the mechanism may allow for greater tension than may be accommodated by expansion elements that expand asymmetrically, pull inward on the edges of a display, and/or do not push outward at opposing points of the sides of a display unit (e.g., the middle of opposing sides).

According to some embodiments, a mechanism is always the same width of the display when the display is flat or collapsed. In some embodiments, the width of the mechanism may stay the same as the width of the display as the mechanism is expanding, contracting, and/or fully expanded.

In some embodiments, a mechanism inserted in a display unit may expand the display unit by pushing out on the sides of the display, and not by pulling in from the edges or corners of the display.

According to some embodiments, a display unit comprising one or more mechanisms described in this disclosure may be folded or collapsed by pushing the center of the two sides of the display together to make a panel of the display flat (e.g., counteracting the expansive force of a corner of a mechanism pushing outward on the middles of the sides of the display). In one embodiment, once the display is flattened as above, if the display includes two or more panels (e.g., separated by fold lines) a user may accordion fold all the panels back down (e.g., for portability and/or storage).

According to some embodiments, by placing two or more mechanisms on top of one another, within a display, the display may carry a load or weight. The load is supported by the diamond shape, for example, edge to edge.

According to some embodiments, a unit comprising at least one mechanism disclosed in this disclosure may be utilized as a gravity feed dispenser (e.g., for allowing customers or other users to access and remove products or other items stored inside the unit through an opening in a surface of the unit).

Although various references are made in this disclosure to a display unit for use in displaying information and/or products, it will be readily understood that an apparatus comprising one or more of the mechanisms disclosed in this disclosure need not necessarily display information or have information printed, for example, on an outer surface of such a unit. For example, this disclosure contemplates a collapsible and expandable apparatus comprising one or more self-expanding and/or load-bearing inserts.

According to some embodiments, the mechanism may be flexibly connected to or suspended by the edges of the unit (e.g., using rubber bands, string, etc.) to prevent the mechanism from falling down through the unit. For example, the mechanism effectively may "float" inside the unit, while pushing outward on opposing sides of the unit.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application.

What is claimed is:

1. A self-expanding mechanism comprising:

a first side connected to a second side at a first corner;

the first side and the second side further being connected by a first contracting element;

a third side connected to a fourth side at a second corner opposite the first corner;

the third side further being connected to the fourth side by a second contracting element, the first side further being connected to the third side at a third corner, and the second side further being connected to the fourth side at a fourth corner; and the first contracting element acting on the first side and the second side to pull the first side and the second side toward each other, and the second contracting element acting on the third side and the fourth side to pull the third side and the fourth side toward each other, thereby allowing the mechanism to self-expand.

2. The self-expanding mechanism of claim 1, wherein the first contracting element acting on the first side and the second side, and the second contracting element acting on the third side and the fourth side, cause the first corner and the second corner to move away from each other.

3. The self-expanding mechanism of claim 1, further comprising at least one connector for connecting the self-expanding mechanism to an interior of a display unit.

4. The self-expanding mechanism of claim 1, wherein the first contracting element acting on the first side and the second side to pull the first side and the second side toward each other, and the second contracting element acting on the third side and the fourth side to pull the third side and the fourth side toward each other, cause the self-expanding mechanism to expand symmetrically.

5. The self-expanding mechanism of claim 1, wherein the first contracting element and the second contracting element are flexibly expandable, allowing for the self-expanding mechanism to be collapsed.

6. The self-expanding mechanism of claim 1, wherein the first contracting element comprises a rubber band.

7. The self-expanding mechanism of claim 1, wherein the first side comprises a hook for attaching the first contracting element to the first side.

8. The self-expanding mechanism of claim 1, wherein at least the first side and the third side are included in a single component.

9. The self-expanding mechanism of claim 8, wherein the single component comprises a fold defining the third corner and flexibly joining the first side and the third side.

10. The self-expanding mechanism of claim 8, wherein the single component comprises an opening in the first side for receiving a flap of the second side to assemble the self-expanding mechanism.

11. The self-expanding mechanism of claim 8, wherein the single component comprises a cardboard substrate.

12. The self-expanding mechanism of claim 1, wherein the first contracting element acting on the first side and the second side to pull the first side and the second side toward each other is simultaneous with the second contracting element acting on the third side and the fourth side to pull the third side and the fourth side toward each other.

13. A display unit comprising:

an outer substrate comprising a first side of the outer substrate connected along a first edge to a second side of the outer substrate opposite the first side of the outer substrate, the first side of the outer substrate further being connected along a second edge to the second side of the outer substrate; and a self-expanding mechanism, affixed to an interior of the outer substrate by a first connection to the first edge and by a second connection to the second edge, the self-expanding mechanism comprising:

a first mechanism side connected to a second mechanism side at a first corner;

the first mechanism side and the second mechanism side further being connected by a first contracting element;

a third mechanism side connected to a fourth mechanism side at a second corner opposite the first corner;

the third mechanism side further being connected to the fourth mechanism side by a second contracting element, the first mechanism side further being connected to the third mechanism side at a third corner, and the second mechanism side further being connected to the fourth mechanism side at a fourth corner; and the first contracting element acting on the first mechanism side and the second mechanism side to push the first corner against the first side of the outer substrate, and the second contracting element acting on the third mechanism side and the fourth mechanism side to push the second corner against the second side of the outer substrate, thereby causing the display unit to expand.

14. The display unit of claim 13, wherein the self-expanding mechanism is a load-bearing insert.

15. The display unit of claim 13, further comprising:

a second self-expanding mechanism affixed to the interior of the outer substrate by a third connection to the first edge and by a fourth connection to the second edge.

16. The display unit of claim 13, wherein the first contracting element acting on the first mechanism side and the second mechanism side to push the first corner against the first side of the outer substrate is simultaneous with the second contracting element acting on the third mechanism side and the fourth mechanism side to push the second corner against the second side of the outer substrate.

17. The display unit of claim 13, wherein the first contracting element acting on the first mechanism side and the second mechanism side to push the first corner against the first side of the outer substrate is symmetrical with respect to the second contracting element acting on the third mechanism side and the fourth mechanism side to push the second corner against the second side of the outer substrate.

18. A self-expanding mechanism comprising:

a first side and a second side connected by a first contracting element, the first side and the second side further being connected at a first edge, the first contracting element being configured with the first side and the second side to pull the first side and the second side toward each other to form a first corner at the first edge;

a third side and a fourth side connected by a second contracting element, the third side and the fourth side further being connected at a second edge, the second contracting element being configured with the third side and the fourth side to pull the third side and the fourth side toward each other to form a second corner at the second edge, opposite the first corner, the first side further being connected to the third side, and the second side further being connected to the fourth side; and wherein the forming of the first corner at the first edge and the forming of the second corner at the second edge cause the first corner and the second corner to move away from each other.

19. The self-expanding mechanism of claim 18, wherein the first contracting element pulling the first side and the second side toward each other is simultaneous with the second contracting element pulling the third side and the fourth side toward each other.

20. The self-expanding mechanism of claim 18, wherein the first side comprises a hook for attaching the first contracting element to the first side.

21. The self-expanding mechanism of claim 18, wherein the first side comprises an opening for receiving a corresponding flap of the second side to connect the first side to the second side at the first edge.

* * * * *